US005536634A

United States Patent [19]

Kim

[11] Patent Number: 5,536,634

[45] Date of Patent: Jul. 16, 1996

[54] SILVER HALIDE EMULSIONS SPECTRALLY SENSITIZED IN THE PRESENCE OF LOW N-ALKYL PYRIDINIUM IONS

[75] Inventor: Sang H. Kim, Pittsford, N.Y.

[73] Assignee: Eastman Kodak Company, Rochester, N.Y.

[21] Appl. No.: 316,002

[22] Filed: Sep. 30, 1994

[51] Int. Cl.[6] ..... G03C 1/18; G03C 1/29

[52] U.S. Cl. ..... 430/585; 430/570; 430/613; 430/567; 430/572

[58] Field of Search ..... 430/570, 572, 430/574, 613, 585, 588, 567, 569

[56] References Cited

U.S. PATENT DOCUMENTS

| | | | |
|---|---|---|---|
| H583 | 2/1989 | Asami | 430/550 |
| 2,288,226 | 6/1942 | Carroll | 430/572 |
| 3,583,870 | 6/1971 | Gilman | 430/583 |
| 3,628,960 | 12/1971 | Mortsel et al. | 430/571 |
| 3,630,744 | 12/1971 | Thiers et al. | 96/101 |
| 3,945,832 | 3/1976 | Shiba et al. | 430/581 |
| 4,471,044 | 9/1984 | Parton et al. | 430/217 |
| 4,536,473 | 8/1985 | Mihara | 430/575 |
| 4,801,525 | 1/1989 | Mihara et al. | 430/518 |
| 4,818,676 | 4/1989 | Baba et al. | 430/587 |
| 4,987,052 | 1/1991 | Hirano et al. | 430/572 |
| 5,108,888 | 4/1992 | Ikegawa et al. | 430/570 |
| 5,328,820 | 7/1994 | Klaus et al. | 430/613 |
| 5,362,621 | 11/1994 | Obi et al. | 430/613 |

FOREIGN PATENT DOCUMENTS

| | | | |
|---|---|---|---|
| 166186 | 10/1953 | Australia | 430/613 |
| 545966 | 9/1957 | Canada | 430/613 |
| 0472004 | 2/1992 | European Pat. Off. | 430/574 |
| 3253349 | 10/1988 | Japan | 430/572 |

*Primary Examiner*—Lee C. Wright
*Attorney, Agent, or Firm*—Paul A. Leipold

[57] ABSTRACT

The invention provides a method of forming a spectrally sensitized emulsion comprising providing a silver bromoiodide emulsion, adding sensitizing dye

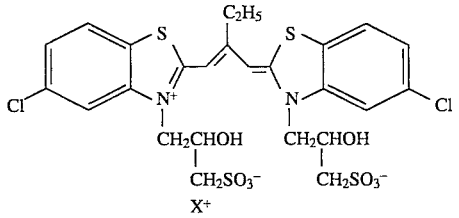

$X^+$ is a cation other than N-alkyl pyridinium, adding an N-alkyl pyridinium salt, and completing the heat cycle for sensitization.

9 Claims, No Drawings

SILVER HALIDE EMULSIONS SPECTRALLY SENSITIZED IN THE PRESENCE OF LOW N-ALKYL PYRIDINIUM IONS

FIELD OF THE INVENTION

This present invention relates to sensitization of light sensitive silver halide emulsions. In particular, it relates to light sensitive silver halide emulsions sensitized in the presence of low N-alkyl pyridinium ions.

BACKGROUND OF THE INVENTION

In order to be competitive in the market and to serve customers better, modern photographic films based on silver halide emulsions need to be manufactured with the highest quality and the lowest cost possible. Robust or reliably reproducible emulsion manufacturing becomes very important in order to meet such requirements.

Spectral sensitizing dyes are usually manufactured as a salt with a counter ion. The counter ion is usually chosen for ease of manufacturing. Photoefficiency of spectral sensitizing dyes is not usually determined by the counter ion. However, in recent tabular grain spectral sensitization experiments, Dye 1 with triethylamine ion as counter ion unexpectedly showed a lack of finish reproducibility and often required much higher temperatures to reach the maximum speed (sensitivity) than Dye 2 with N-ethylpyridinium ion as counter ion.

L. E. Oppenheimer, A. H. Herz, and T. H. James reported that N-alkyl pyridinium or quinolinium ions and their chain substituted analogs promoted growth of Lippmann-type silver bromide grains; (Oppenheimer, James, Herz in particle Growth in Suspensions, A. L. Smith ed., Academic Press, London, 1973, p.159). Adsorption properties of such cationic surfactants are reported by J. F. Padday and A. H. Herz in Chaper 1 of the 4th Edition of The Theory of the Photographic Process, T. H. James ed., Macmillan, 1977, p. 25.

A recent European Patent Application 0 472 004A of Dobles et al disclosed supersensitizer combinations of low staining dyes such as Dye 1 and Dye 2.

Problem to be Solved by the Invention

There is a desire to increase the performance of spectral sensitizing dyes particularly those of the class including Dye 1. It is desired that such dyes provide higher speed, higher contrast, and optimum speed/fog while providing a wide range of extent of finish. A wide range of extent of finish would provide a more robust emulsion. A robust finish does not have significant deviations caused by a change in finishing temperature or a length of time the emulsion is heated to finish it.

SUMMARY OF THE INVENTION

The invention in a preferred form provides a method of forming a spectrally sensitized emulsion comprising providing a silver bromoiodide emulsion, adding sensitizing dye

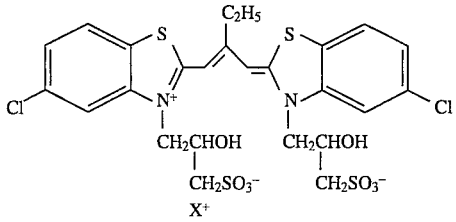

$X^+$ is a cation other than N-alkyl pyridinium, adding an N-alkyl pyridinium salt and completing the heat cycle for sensitization. The invention also provides an emulsion formed by the process.

Advantageous Effect of the Invention

This invention has numerous advantages over the use of dyes without the addition of the N-alkyl pyridinium salt. The use of the pyridinium salt to the sensitizing dye provides higher speed, better speed/fog, and high contrast at low finish temperatures. Further, the combination of dyes of the invention type with the N-alkyl pyridinium ion provides the wider sensitizing plateau, thereby making the finish using the invention more robust, thereby being less sensitive to other changes in finishing temperature or time. Further, while dyes with pyridinium counter ions are difficult to manufacture, the instant invention allows the use of the easier to manufacture dyes in combination with the pyridinium salt to achieve a lower cost and more reliable finish than that available utilizing simply the pyridinium dyes. It is unexpected that the pyridinium ion added to a dye manufactured with a different counter ion would result in any improvement in sensitized performance.

DETAILED DESCRIPTION OF THE INVENTION

The N-alkyl pyridinium ions of the pyridinium salt of this invention are represented by the formula

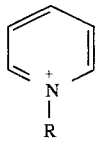

where R represents alkyl groups having less than 8 carbons. This cation is being incorporated as salt form with an anion such as hydroxide, chloride, bromide, iodide, nitrate, perchlorate, or para toluenesulfonate. Examples of preferred compounds include:

Compound 1: N-ethylpyridinium bromide

Compound 2: N-octylpyridinium para toluenesulfonate

Compound 3: N-hexylpyridinium chloride

The optimal amount of the low N-alkyl pyridinium ions to be added will depend on the desired final result, type of emulsion, type of optical sensitizing dyes, the degree of digestion, the structure of the low N-alkyl pyridinium ions, and other variables. In general, desired concentration of the low N-alkyl pyridinium ions is at least 0.1 milimole per silver mole, but not more than 1.5 times optical sensitizing dye concentration. Most preferred concentration is about equimolar to the optical sensitizing dye concentration for most efficient use of the pyridinium ions.

The invention has been described for use with the preferred sensitizing dye. However, the invention also could be practiced with other sensitizing dyes that give a preferred sensitization when other counter ions other than the ones they are formed with are present. The formation with one cation may be cheaper and/or more uniform while sensitization with a second different cation present may produce a better sensitization. The second cation may be introduced by addition of a second salt during sensitization.

Any suitable silver bromoiodide emulsion may be utilized. A preferred emulsion has been found to be tabular silver bromoiodide emulsion grains. The tabular silver halide emulsion grains have a tabularity of greater than 25 comprising greater than 50 percent of the projected area of the emulsion. The tabularity is defined as equivalent circular diameter divided by square of grain thickness. While $X^+$ cation of the sensitizing dye of the invention is set forth above as other than N-alkyl pyridinium, it may be any suitable ion to complete the salt. Typical of such cations are hydrogen, sodium, potassium, and ammonium. A preferred cation is the $(C_2H_5)_3$ N $H^+$, as this is a dye providing relatively low cost and reproducible manufacturing. Any order of addition of the sensitizing dye of the invention and the N-alkyl pyridinium ions may be utilized during the finishing process. However, it hat been found that the finish is preferred if the pyridinium salt is added prior to the sensitizing dye, as the finish is somewhat more efficient resulting in greater sensitization.

The emulsions of the invention may be utilized in any photographic element. Typical of such photographic elements are color paper, negative films, and reversal films. The emulsions may be used in any of the cyan, magenta, or yellow layers, alone or in combination with other sensitized emulsions. After exposure the emulsions may be developed by any conventional developer.

The following examples are intended to illustrate, without limiting, invention. The following compounds are utilized in the examples:

Compound 1: N-ethylpyridinium bromide

Compound 4: p-acetamidophenyl disulfide

Compound 5: 4-hydroxy-6-methyl,1,3,3a,7-tetraazaindene

Compound 6: 3-(2-methylsulfamoyl)-benzothiazolium tetraflouroborate

Compound 7: sodium thiosulfate pentahydrate

Compound 8: sodium aurous(I) dithiosulfate dihydrate

Dye 1 Triethylamine salt

Dye 2 N-ethylpyridinium salt

Dye 3

Coupler A (See the listing at the end of the examples for structures of dyes and coupler)

EXAMPLE 1

Emulsion A (Control)

An iridium doped 1.1 μm×0.10 μm thick 2 mole%I silver bromoiodide tabular grain emulsion (tabularity=110) was prepared by a double jet procedure with deionized bone geletin for nucleation and deionized oxidized gelatin for growth. The washed emulsion was chemically and spectrally sensitized by adding 1.5 mg Compound 4, 150 mg NaCNS, 0.8 mmole Dye 1, 0.08 mmole Dye 3, 2.9 mg Compound 8, 2.0 mg Compound 7, and 10 mg Compound 6 for one mole of emulsion followed by finish at various temperatures (shown in Table 1) for 10 min. Both Dyes 1 and 2 were dispersed in a gelatin dispersion before adding to the emulsion.

Emulsion B (Invention)

Emulsion B was prepared similarly to the Emulsion A except that aqueous solution of 0.8 mmole Compound 1 per one mole of silver was added before Dye 1.

Emulsion C (Comparative)

Emulsion C was prepared similarly to the Emulsion A except that Dye 2 replaced Dye 1 for comparison.

75 mg/sq. ft. sensitized emulsions were coated with 1.75 g Compound 5/mole silver, 150 mg/sq. ft. Couplers A and gelatin (220 mg/sq. ft.) over antihalation cellulose acetate support followed by a 200 mg/sq. ft. gelatin overcoat with sufactant and hardner.

The coatings were exposed to 5500K with Kodak Wratten 23A filter for 1/50 sec. and were processed for 4 min. in E6 process *British Journal of Photography Annual,* 1982, pp. 201–302). Relative speed was measured at a density of 0.3 below maximum density (Dmax) and was expressed in log E multiplied by 100. Gamma is a contrast at 1.0 density. Percent fog was determined by (minimum density/maximum density)×100 from a process which developed the emulsion coatings to form a negative black-and-white image for 4 minutes:, followed by forming a negative color image. Photgraphic test results are summarized below in Table 1.

TABLE 1

| Sample No. | Emulsion No. | Finishing Temperature | % Fog | Speed | Gamma |
|---|---|---|---|---|---|
| 1 | A (Control) | 68° C. | 8.6 | 210 | −198 |
| 2 | A (Control) | 71° C. | 11.2 | 213 | −191 |
| 3 | A (Control) | 74° C. | 11.3 | 200 | −175 |
| 4 | B (Invention) | 68° C. | 9.4 | 217 | −189 |
| 5 | B (Invention) | 71° C. | 10.1 | 216 | −191 |
| 6 | B (Invention) | 74° C. | 10.1 | 215 | −194 |
| 7 | C (Comparison) | 68° C. | 10.0 | 217 | −209 |

Finishing

As shown above, the inventive samples provided high speed, more stable speed, fog, and gamma (contrast) when compared to the control.

The Compound 1 accelerated finish (sensitization) to an optimum at 68° C. and maintained the speed plateau from 68° C. to 74° C. The inventive samples provided results similar to the comparative sample sensitized by the Dye 2 comprising NEtPy salt.

EXAMPLE 2

Emulsion D (Control)

An iridium doped 0.48 μm×0.07 μm thick 4%I AgBrI tabular grain emulsion (tabularity=98) precipitated in deionized oxidized gel. This washed emulsion was chemically and spectrally sensitized like Emulsion A except that 2 mg Compound 4, 200 mg NaCNS, 1.1 mmole Dye 1, 0.11 mmole Dye 3, 8 mg Compound 8, 5.3 mg Compound 7 and 35 mg Compound 6 for one mole of emulsion were used and finish heat time was 5 minutes.

Emulsion E (Invention)

Emulsion E was prepared like Emulsion D except that 1.1 mmole Compound 1 per mole of silver was added before Dye 1.

All other experiments were similarly performed as described in the Example 1. Photographic results are tabulated in Table 2. The inventive samples showed higher speed and lower fog at lower digestion temperatures.

TABLE 2

| Sample No. | Emulsion No. | Digestion Temperature | % Fog | Speed | Gamma |
|---|---|---|---|---|---|
| 8 | D (Control) | 60° C. | 9.2 | 126 | −225 |
| 9 | D (Control) | 65° C. | 8.7 | 137 | −240 |
| 10 | D (Control) | 70° C. | 8.2 | 151 | −231 |
| 11 | E (Invention) | 60° C. | 7.6 | 137 | −175 |
| 12 | E (Invention) | 65° C. | 7.9 | 161 | −223 |
| 13 | E (Invention) | 70° C. | 7.8 | 165 | −215 |

EXAMPLE 3

Ionic salts in regular gelatins are removed to manufacture deionized gelatin. To simulate emulsion prepared with regular gelatin, Ca++ was added as Ca(NO3)2 to emulsion prepared with deionized gelatin. The Ca++ content in the emulsion often controls dye aggregation and finish rate. This example demonstrates effect of Compound 1 in the presence of Ca++ relative to NaBr.

Emulsion F (Control)

An emulsion similar to Emulsion D was prepared except using 1.8 mg Compound 4, 180 mg NaCNS, 1.05 mmole Dye 1, 0.11 mmole Dye 3, 8.4 mg Compound 8, 5.5 mg Compound 7 and 32 mg Compound 6 for one mole of emulsion and 10 min. digestion time. 6 mmole calcium nitrate per mole of silver was added after NaCNS.

Emulsion G (Invention)

Emulsion G was prepared like Emulsion F except 1.05 mmole Compound 1 per silver mole was added just before Dye 1.

Emulsion H (Comparison)

Emulsion H was prepared like Emulsion F except 1.05 mmole NaBr per silver mole was added just before Dye 1.

All other experiments were similarly performed as described in the Example 1. Photographic results are tabulated in Table 3.

TABLE 3

| Sample No. | Emulsion No. | Finishing Temperature | % Fog | Speed | Gamma |
|---|---|---|---|---|---|
| 14 | F (Control) | 62° C. | 11.7 | 143 | −216 |
| 15 | F (Control) | 65° C. | 10.6 | 153 | −181 |
| 16 | F (Control) | 68° C. | 11.4 | 164 | −213 |
| 17 | G (Invention) | 62° C. | 11.3 | 154 | −171 |
| 18 | G (Invention) | 65° C. | 11.5 | 165 | −208 |
| 19 | G (Invention) | 68° C. | 12.6 | 171 | −220 |
| 20 | H (Comparison) | 62° C. | 12.1 | 127 | −208 |
| 21 | H (Comparison) | 65° C. | 11.0 | 142 | −207 |
| 22 | H (Comparison) | 68° C. | 10.3 | 157 | −201 |

The inventive samples reached higher speed and contrast at lower digestion temperatures. N-Ethyl pyridinium ion was responsible for the accelerated finish than Br−.

EXAMPLE 4

Two times more Compound 1 was added to prepare Emulsion I and compared with Emulsion G as shown in Table 4.

TABLE 4

| Sample No. | Emulsion No. | Finishing Temperature | % Fog | Speed | Gamma |
|---|---|---|---|---|---|
| 23 | I (Comparison) | 62° C. | 10.5 | 152 | −180 |
| 24 | I (Comparison) | 65° C. | 10.6 | 155 | −189 |
| 25 | I (Comparison) | 68° C. | 11.2 | 163 | −213 |

These results are similar to the Emulsion F (Control) which suggested that too much Compound 1 are not beneficial.

As can be seen by the above examples, the addition of N-alkyl pyridinium ion to the sensitizing dye of the invention containing another cation surprisingly results in a finish comparable or better than that when the dye is formed having the pyridinium ion present as in Dye 2. This results in a lower cost process, as Dye 2 is expensive and difficult to manufacture, whereas dye such as Dye 1 is relatively low in cost to manufacture as is the pyridinium salt. Therefore, tile benefit of a more expensive dye to make is obtained without the expense of its formation.

Dye 1

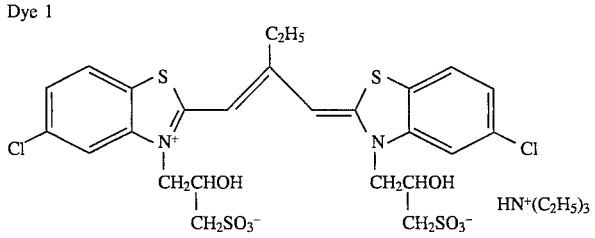

Dye 2

-continued

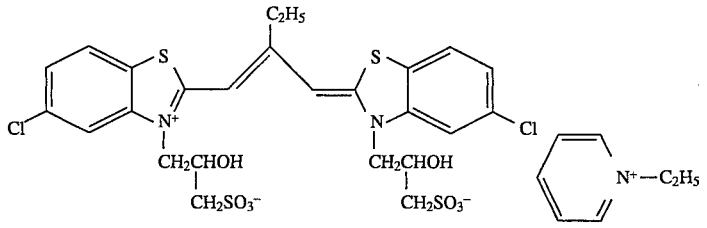

Dye 3

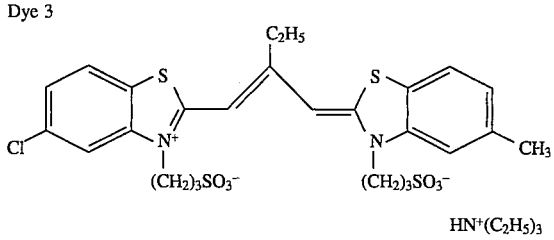

Coupler A

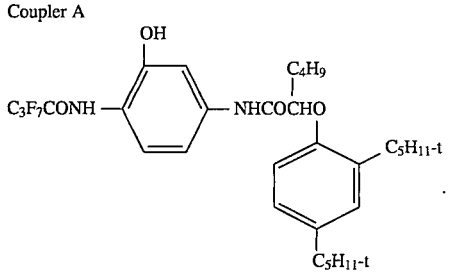

The invention has been described in detail with particular reference to preferred embodiments thereof, but it will be understood that variations and modifications can be effected within the spirit and scope of the invention.

I claim:

1. A method of forming a spectrally sensitized emulsion comprising providing a silver bromoiodide emulsion, adding sensitizing dye

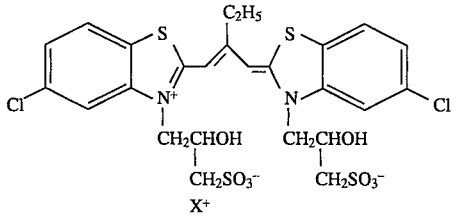

$X^+$ is a cation other than N-alkyl pyridinium, adding an N-alkyl pyridinium salt wherein the pyridinium ion of said pyridinium salt comprises

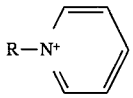

wherein R represents alkyl groups of less than 8 carbons, and heating for sensitization.

2. The method of claim 1 wherein $X^+$ is $Na^+$, $H^+$, $NH_4^+$ or $R'_3NH^+$, where R' is an alkyl group.

3. The method of claim 1 wherein $X^+$ comprises $(C_2H_5)_3NH^+$.

4. The method of claim 1 wherein said salt comprises at least one of hydroxide, chloride, bromide, iodide, nitrate, perchlorate, and para toluenesulfonate as anion to form said salt.

5. The method of claim 1 wherein said pyridinium salt is added in an amount of between about 1 and 1.5 times the molar concentration of said sensitizing dye.

6. The method of claim 1 wherein the said sensitizing dye and said pyridinium salt are added prior to increasing the heat to the temperature used to sensitize said emulsion.

7. The method of claim 1 wherein said heat cycle is to between about 65° C. and about 74° C.

8. The method of claim 1 wherein said emulsion comprises tabular silver bromoiodide grain.

9. The method of claim 1 wherein said pyridinium salt comprises

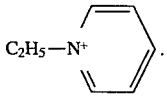

* * * * *